United States Patent [19]

Mallard et al.

[11] Patent Number: 4,656,449

[45] Date of Patent: Apr. 7, 1987

[54] FIELD MODIFYING ELEMENTS FOR AN ELECTROMAGNET HAVING A SUBSTANTIALLY C-SHAPED YOKE

[76] Inventors: J. R. Mallard, 121 Anderson Drive, Aberdeen AB2 6BG; F. E. Neale, 70 Beaconsfield Place, Aberdeen AB2 4AJ, both of Scotland

[21] Appl. No.: 820,753

[22] Filed: Jan. 21, 1986

[30] Foreign Application Priority Data

Jan. 21, 1985 [GB] United Kingdom ..... 8501442

[51] Int. Cl.[4] ..... H01F 3/00

[52] U.S. Cl. ..... 335/297; 336/211; 324/318; 335/299

[58] Field of Search ..... 335/296, 297, 299, 281; 336/211; 324/318, 320

[56] References Cited

U.S. PATENT DOCUMENTS 4,553,122 11/1985 Young ..... 335/297 X

*Primary Examiner*—George Harris

*Attorney, Agent, or Firm*—Silverman, Cass, Singer & Winburn, Ltd.

[57] ABSTRACT

An electromagnet having a ferromagnetic core comprising at least one substantially C-shaped yoke terminating in pole pieces (1,2) with opposed pole faces (7) separated by an air gap in which a magnetic field suitable for an NMR imaging process is, in use, produced, the core comprising stacked laminae (6) of electrical sheet steel, which are bent around the C about axes perpendicular to the plane of the C, and at least some of which are spaced apart at the pole pieces to accommodate between the spaced laminae field modifying elements (5,8) which are arranged to improve the homogeneity and/or confinement of the magnetic field in the air gap.

8 Claims, 7 Drawing Figures

FIELD MODIFYING ELEMENTS FOR AN ELECTROMAGNET HAVING A SUBSTANTIALLY C-SHAPED YOKE

This invention relates to an electromagnet which provides a field suitable for use in nuclear magnet resonance (NMR) imaging systems, although its use is not restricted to this purpose.

One requirement for an NMR imaging system is the provision of field homogeneity over the imaging volume, which should not be adversely affected by either stationary or mobile ferromagnetic objects near to the room in which the system is used. There is also a requirement for reasons of health and safety that a fringe field in excess of 5 Gauss arising from the system magnet should not extend to regions beyond the immediate neighbourhood of the imager. It is desirable for the system to be capable of operating at low field strengths, in order to display maximum disease contrast, and also at a field strength sufficiently elevated to show improved anatomical detail. Indeed, a range of several field strengths may prove to be useful, each one optimal for the detection and display of a respective range of pathology.

It is expensive and/or technically difficult to meet these requirements using superconducting, resistive or permanent magnets.

In accordance with the present invention, an electromagnet has a ferromagnetic core comprising at least one substantially C-shaped yoke terminating in pole pieces with opposed pole faces separated by an air gap in which a magnetic field suitable for an NMR imaging process is, in use, produced, the core comprising stacked laminae of electrical sheet steel, which are bent around the C about axes perpendicular to the plane of the C, and at least some of which are spaced apart at the pole pieces to accommodate between the spaced laminae field modifying elements which are arranged to improve the homogeneity and/or confinement of the magnetic field in the air gap.

This arrangement provides a comparatively cheap and simple way of assembling the core of an electromagnet to provide the desirable magnetic field characteristics in the air gap between the pole piece faces. The field modifying elements accommodated between the spaced laminae of the pole pieces may be plates of electrical steel, or other ferromagnetic material, of appropriate shape and dimensions parallel and perpendicular to the pole piece faces. Typically the spaces between the laminae will be of the same order of magnitude as the thickness of individual ones of the laminae, and the inserted plates may be of similar material as the laminae.

Alternatively, the field modifying elements may be copper wires or other electrical conductors, which extend through the spaces between the spaced laminae, usually substantially parallel to the pole piece faces, and which are arranged to carry an appropriate current for contributing a modifying magnetic field superimposed on that produced by the main coil or coils of the electromagnet.

A particular advantage of the new construction is that adequately homogeneous and confined magnetic fields of different strengths may be provided in the air gap between the pole piece faces, by the simple expedient of making the field-modifying effect of the elements variable. For example, if the elements are ferromagnetic plates, which are not permanently fixed in position between the spaced laminae of the yoke, they may be adjustable in position or selectively insertable to provide the appropriate modifying influence on the magnetic field produced essentially by appropriate energisation of the main coil or coils of the electromagnet. Similarly, when current carrying conductors are used, these may be selectively inserted into the spaces, or, if permanently fitted, selectively energised.

The laminae preferably extend fully around the yoke, but they may be associated with a solid portion, for example midway around the C, where a coil or coils of the electromagnet is wound. In any case, the laminae of electrical sheet steel are preferably grain oriented, particularly by rolling, to provide a direction of easy magnetisation around the C from pole piece to pole piece.

The invention will now be described in more detail and by way of example with reference to the accompanying drawings, in which.

Figure 1:
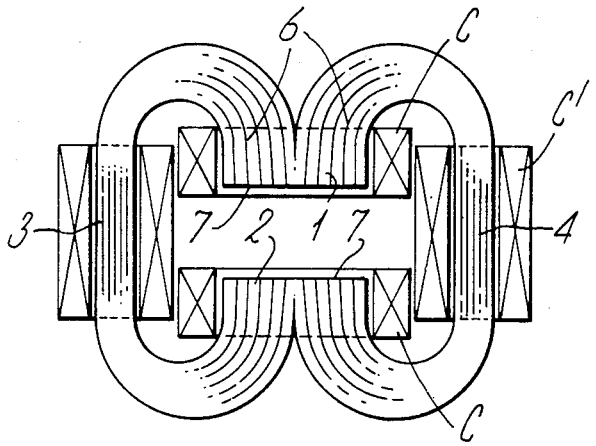
FIGS. 1 and 2 are diagrammatic views of two electromagnets in accordance with the invention.

FIG. 1 is a diagrammatic cross section of a double-yoked arrangement wherein the main energising coils may be wound either around the pole pieces 1 and 2 of the magnetic circuit as shown at C, or around the mid-portions 3 and 4 of the yokes as shown at C'.

Figure 2:
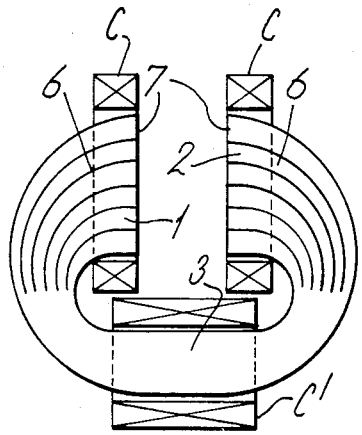

FIG. 2 is a similar cross section of the more common single C-type design where again the main energising coils may be wound either around the pole pieces 1 and 2 as shown at C or the mid point of 3 of the yoke as shown at C'.

Figure 3:
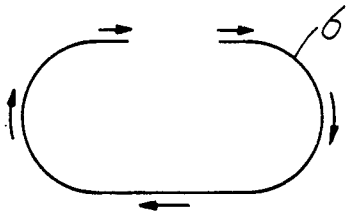
FIG. 3 is a diagrammatic view of one lamina of one of the electromagnet cores.
Figure 4:
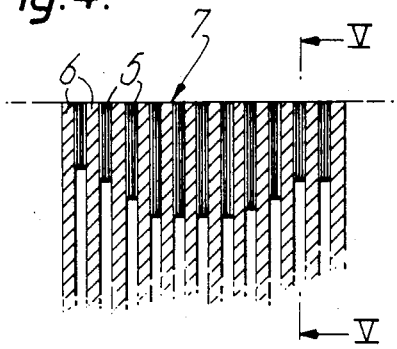
FIG. 4 is a section perpendicular to the core laminae adjacent to a pole face.
Figure 5:
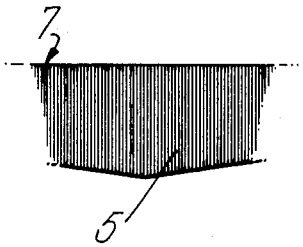
FIG. 5 is a section taken on the line V—V in FIG. 4.
Figure 6:
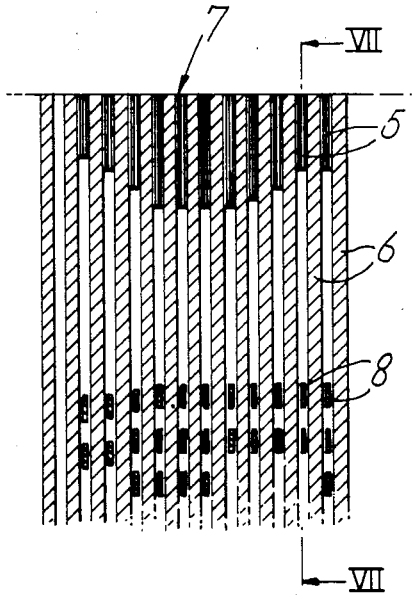
FIGS. 6 and 7 are views similar to FIGS. 4 and 5 but of a modified arrangement.
Figure 7:
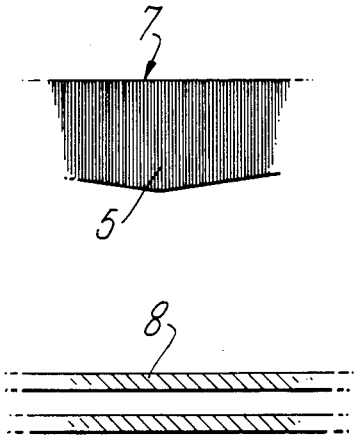

The pole pieces, together with part or all of each yoke are constructed by stacking thin sheets 6 of low-loss grain oriented electrical steel, particularly silicon-iron, bent into the shape shown schematically in FIG. 3, such that the flux within each sheet remains substantially in the plane of the sheet and parallel to the direction of easy magnetisation as shown by the arrow in FIG. 3, which is the direction of rolling the sheet during its manufacture.

Although the sheets may be closely packed together around most of each C-shaped yoke, they are spread and become more widely spaced as they pass through the pole pieces to the respective pole piece faces at the ends of the C. There the width of the spaces between adjacent sheets is preferably of the order of the thickness of the sheets themselves, the actual width depending on the magnitude of the NMR field for which the magnet is designed. These spaces between the sheets near to the faces of the pole pieces are utilised to accommodate elements for shimming the magnetic field between the opposed faces of the pole pieces, that is to say to adjust or correct the flux density distribution between the pole pieces in order to ensure a sufficiently high uniformity over the magnetic field over a volume large enough for NMR imaging, and/or to minimize flux leakage from this volume.

In an electromagnet, the following relationship exists between the field B in the imaging volume, the area A of the pole faces of the magnet, the magnetic flux density $B_m$ in the yoke and the area of cross-section $A_m$ of the yoke:

$$BA(1+S)=B_mA_m$$

where S is the so-called "leakage flux factor". This formula, which may be expressed in alternative equivalent forms, may be found in many textbooks and other works (see for example: "The Physics of Experimental Method" by H J J Braddick, Chapman and Hall 1954, p 144; "Magnetic Materials" by F Brailsford, Methuen/-Wiley, 1951; Cousins J E and Nash W F, Brit J Appl Phys 10, 471, 1959).

Where the magnetic field intensity is not required to exceed a value of about one quarter of the saturation flux density of electrical sheet steel, B is much less than $B_m$ and the area A can be made larger than $A_m$ by an amount which depends on the leakage flux factor S. Advantage is taken of this circumstance in the present invention to provide means of distributing the magnetic flux density at the pole faces in such a way as to ensure that the field in the gap between the pole faces 7 is uniform over a large enough volume to be used for magnetic resonance imaging.

A first method of shimming to provide a primary correction to the field inhomogeneity is illustrated in FIGS. 4 to 7. This involves inserting ferromagnetic shim strips 5 of electrical sheet steel between the silicon-iron sheets 6 which form the main ferromagnetic core of the magnet. These strips may have one end coinciding with the pole face 7 and they may be grain oriented and have directions of easy magnetization parallel to those of the adjacent sheets 6. The width, thickness and distribution of the strips may vary across the pole face in directions both parallel and perpendicular to the planes of the sheets 6, as suggested in FIGS. 4 and 5 for example. The strips 5, together with the sheets 6, are bonded together by a suitably electrically insulating epoxy resin bond.

A second method of shimming, which may be used independently or in conjunction with the first method, involves inserting insulated wires or strips 8 of copper, or other electrical conductor, between adjacent sheets or groups of sheets 6 of the magnet core. These conductors run substantially perpendicular to the direction of the magnetic flux within the sheets as shown schematically in FIGS. 6 and 7. They are bonded to the sheets 6 by means of an electrically insulating epoxy resin bond, a gap being left between these conductors and the ferromagnetic strips 5 when used. Currents of such magnitudes and distributions are passed through these conductors 8 in order further to improve the homogeneity of the field in the gap between the pole faces.

A third method of shimming is useful in the event that the magnetic field, and hence the operating frequency for NMR imaging, is varied by changing the current passing through the main energising coils C,C′ of the magnet. If, as a result of changing the magnitude of the operating field, its uniformity is disturbed, the magnet can be reshimmed by inserting additional ferromagnetic strips, or current carrying conductors, in the gaps between the sets of bonded strips and conductors 5 and 8. These latter inserts are either enclosed within insulated sleeving or may lie between thin insulating sheets of PVC or similar material and may be inserted or removed at will. Their geometry and distribution can also be varied in directions perpendicular to the main flux lines within the pole pieces until the required degree of homogeneity in the field is attained.

The three described provisions for shimming an electromagnet do not preclude the utilization of other well known means for attaining a uniform field distribution and are to be thought of rather as additions to these other means. For example, the pole faces defined by the surfaces passing through the ends of the electrical sheet steel laminae, forming the main part of the magnetic circuit, may not necessarily be plane, nor need the sheets be necessarily perpendicular to the pole face. They may either have a gradually varying curvature over the whole area or they may have a stepped shape or correction rims such as that described for example in "Laboratory Magnets" by D J Kroon, p 184 (Philips Technical Library, 1968). Optionally, the pole faces may also be covered with a thin sheet or sheets of a ferromagnetic material in order to reduce unwanted variations in flux density which may occur close to the pole faces, a technique which is also described in the above mentioned book on p 192.

Provided that the flux density $B_m$ is sufficiently far below the saturation flux density of the ferromagnetic core, its permeability will remain high, to ensure a degree of shielding of the imaging field region from external magnetic disturbances. Also, if the upper limit of the field intensity in the gap between the pole pieces is limited to about one quarter of the saturation flux density of the electrical steel used in their construction, a large volume field with sufficient uniformity for NMR imaging, but with a fringe field of the surroundings of the imager not exceeding 5 Gauss, can be attained with a magnet of the construction described and illustrated.

What is claimed is:

1. An electromagnet having a ferromagnetic core comprising at least one yoke of substantially C-shape terminating in pole pieces with opposed pole faces separated by an air gap in which a magnetic field suitable for an NMR imaging process is, in use, produced, said core comprising stacked laminae of electrical sheet steel, which are bent around said C about axes perpendicular to the plane of said C, and at least some of which are spaced apart at said pole pieces to accommodate between said spaced laminae field modifying elements which are adapted to effect modification of said magnetic field to improve at least one of the homogeneity and confinement of said magnetic field in said air gap.

2. An electromagnet according to claim 1, in wherein said field modifying elements include plates of ferromagnetic material.

3. An electromagnet according to claim 2, wherein said spaces between said laminae are of the same order of magnitude as the thickness of individual ones of said laminae.

4. An electromagnet according to claim 1, wherein said field modifying elements include electrical conductors which are adapted to carry a current for contributing a modifying magnetic field superimposed on that produced by a main coil or coils of said electromagnet.

5. An electromagnet according to claim 4, wherein said electrical conductors are copper wires extending substantially parallel to said pole piece faces.

6. An electromagnet according to claim 1, having at least one main coil which is adapted to be energised by a plurality of different currents to produce magnetic fields of correspondingly different strengths, said field modifying effects of said elements being variable to correspond with said fields of different strengths.

7. An electromagnet according to claim 6, wherein said field modifying elements are adjustable in position or selectively insertable to provide the appropriate modifying influence on said magnetic field.

8. An electromagnet according to claim 1, wherein said laminae of electrical sheet steel are grain oriented to provide a direction of easy magnetisation around said C from one to the other of said pole pieces.

* * * * *